United States Patent [19]

Saelzer

[11] Patent Number: 4,773,682

[45] Date of Patent: Sep. 27, 1988

[54] SASH LOCK

[76] Inventor: Heinrich Saelzer, c/o Heinrich Saelzer, Industriestrasse 4, 3550 Marburg-Wehrda, Fed. Rep. of Germany

[21] Appl. No.: 25,611

[22] Filed: Mar. 13, 1987

[30] Foreign Application Priority Data

Mar. 21, 1986 [DE] Fed. Rep. of Germany ..... 3609584

[51] Int. Cl.[4] ..... E05C 9/00

[52] U.S. Cl. ..... 292/143; 292/161; 292/341.19; 292/DIG. 40; 292/DIG. 53

[58] Field of Search ..... 292/143, 40, DIG. 39, 292/DIG. 40, 161, DIG. 60, DIG. 53, 341.19

[56] References Cited

U.S. PATENT DOCUMENTS

| | | | |
|---|---|---|---|
| 1,684,134 | 9/1928 | Mesurier | 292/DIG. 40 X |
| 1,769,489 | 7/1930 | Carrier | 292/DIG. 39 X |
| 1,863,032 | 6/1932 | Seelinger | 292/DIG. 40 X |
| 1,887,842 | 11/1932 | Holden | 292/DIG. 39 X |
| 2,275,760 | 3/1942 | Hoffman | 292/341.19 |
| 3,097,873 | 7/1963 | Casebolt | 292/341.19 |

FOREIGN PATENT DOCUMENTS

| | | | |
|---|---|---|---|
| 1103647 | 5/1955 | France | 292/161 |
| 325116 | 2/1935 | Italy | 292/40 |
| 482963 | 4/1938 | United Kingdom | 292/DIG. 40 |
| 2110288 | 6/1983 | United Kingdom | 292/341.19 |

*Primary Examiner*—Lloyd A. Gall

*Attorney, Agent, or Firm*—W. G. Fasse; D. H. Kane, Jr.

[57] ABSTRACT

A sash frame is locked to a stationary jamb by movable locking elements connected to an operating rod and cooperating with stationary locking elements. Both types of locking elements have at least one recess, one projection and at least one lateral support extension alongside the respective recess or projection. The recesses and projections are so constructed and arranged that they have a respective central axis extending in parallel to a frame plane defined by the jamb and sash frame in the closed state. The lateral support extensions have surfaces facing each other and extending substantially perpendicularly to the frame plate. The operating rod carrying the movable locking elements may be guided in a groove in the sash frame or in the jamb, whereby the stationary locking elements are connected to the jamb or to the sash frame respectively.

7 Claims, 2 Drawing Sheets

SASH LOCK

FIELD OF THE INVENTION

The invention relates to a sash lock for interlocking a movable sash frame with a stationary jamb. Such locks may be used for windows or doors, especially patio doors.

DESCRIPTION OF THE PRIOR ART

The interlocking of a movable sash frame with a stationary jamb takes place conventionally by means of stationary and movable locking elements, whereby the movable locking elements are connected to a push rod which is slidably guided in a respective groove, either in the sash frame, or in the jamb. The push rod is operated by a manual lever for raising and lowering the movable locking element or elements which are thus displaced in the axial direction of the push rod. The movable locking element or elements are coupled with the stationary locking element or locking elements in the interlocking position, whereby a tilting movement of the sash frame relative to the jamb is prevented. In this interlocking position at least one projection of each locking element engages at least one recess of each respective locking element. The projections and recesses may be provided in the movable and/or in the stationary locking elements. In the locking condition the movable and stationary locking elements are at the same elevation whereas they are at different elevations in the unlocked condition. The movable locking elements are moved into a higher or lower level or elevation with the aid of the above mentioned push rod.

A safe interlocking of the movable sash frame with the stationary jamb is assured in prior art devices only if the projections and the respective recesses of the locking elements have substantial dimensions sufficient for withstanding any force directed to open a locked door or window, and if the locking elements are spaced from one another at relatively small spacings along the length of the sash frame member, and along the length of the jamb. Only the just mentioned substantial dimensions of the locking elements in combination with the close spacing between neighboring locking elements assures the intended force locking of the sash frame to the jamb. A substantial dimension of the projections and recesses can be accomplished only if the respective locking elements themselves have the required substantial dimensions to accommodate projections and recesses of substantial size. Such large locking elements in turn require a substantial gap width between the neighboring sash frame member and jamb member. However, a large gap width between the sash frame and the jamb is undesirable for several reasons. A large gap, for example, makes it difficult to achieve the desired sealing to keep out draft and to avoid heat loss. Further, large locking elements use up more material and require larger dimensioned sash frame members as well as larger dimensioned jamb members. An embedding or recessing of the locking elements into the sash frame member and into the jamb member is also not possible because it would reduce the cross-sectional area of these members which is undesirable from a strength point of view. Further, the desired coupling function can be accomplished only if the locking elements reach into the gap between the sash frame member and the jamb member facing each other.

Further, prior art locking elements are so constructed that the interlocking projections and recesses of the locking elements have a cross-sectional central axis extending perpendicularly to a plane defined by the sash frame and the jamb when the sash frame is in the closed position. Due to this construction it is, for example, necessary that the locking element is connected to the jamb member by means of a force deflection component which is exposed to bending loads. Accordingly, in order to take up the respective bending stress, this component also must have substantial dimensions.

OBJECTS OF THE INVENTION

In view of the foregoing it is the aim of the invention to achieve the following objects singly or in combination:

to construct a sash lock so that the respective locking elements will require a smaller space than was required heretofore;

to assure that the gap width between the sash frame member and the jamb member can be optimally small, whereby nevertheless, the locking elements can be so constructed that the locking elements in their interlocked state provide a high resistance against a force tending to break the interlocking;

to altogether avoid a force deflection component exposed to high bending stress;

to make the replacement of the locking elements simple by a simple connection of the locking elements to the respective sash frame member or jamb member;

to connect the locking elements to the sash frame member and to the jamb member in such a way that they will provide a substantial resistance against any forces tending to twist the locking elements about their longitudinal axis;

to construct the locking elements in such a way that their deformation in response to a force tending to break the interlocking is minimal; and to provide lateral support extensions which are so arranged that they come to bear against each other for reinforcement as soon as the interlocking projections and recesses are displaced only slightly.

SUMMARY OF THE INVENTION

The sash lock according to the invention is characterized in that the projections and recesses have a cross-sectional central axis which extends in parallel to the plane defined by the sash frame and the jamb when the sash frame is closed. The recesses of each locking element have at least one edge strip, or rather, a lateral support extension, which cooperates with the edge strip or lateral extension of the other locking element, whereby surfaces of these lateral extensions or edge strips facing each other extend substantially perpendicularly to said frame plane. The combination of these features avoids the above mentioned force deflection component for the locking elements entirely. This orientation of the projections and recesses with their main central axis or plane in parallel to the frame plane, does not avoid a bending stress on the projections and walls forming the recesses. However, it is nevertheless possible that these locking elements can have relatively small dimensions due to the additional lateral support extensions or edge strips arranged so that the surfaces of these support extensions facing or bearing against each other in the closed position of said movable sash frame, take up more and more of any bending force that may occur the more the sash frame moves out of its closed position. The surfaces of these lateral support extensions become bearing surfaces, for example when a projection of a locking element is bent by more than a certain small angle. Any bending of the respective projection beyond said angle is prevented by these lateral extension supports because the respective surfaces then start taking up compression loads which they transfer into the sash frame member and into the jamb member which together form a gap in which the sash lock is located, whereby damage to the projections and recesses is prevented. Even if a deformation of the projections and deformations of the locking elements takes place, it is thus kept within a narrow limit so that the interlocking is maintained.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
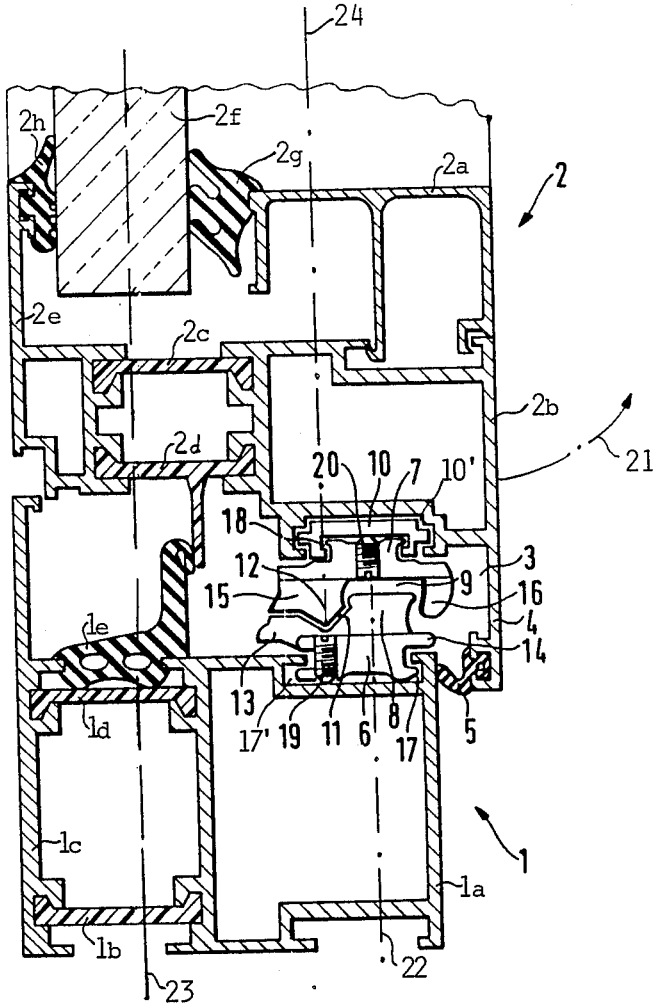
FIG. 1 is a sectional view through one sash frame member and through one jamb member, whereby the sectional plane extends perpendicularly to a plane defined by the sash frame and by the jamb when the sash frame is closed.

FIG. 1 shows a jamb member 1 comprising jamb sections 1*a*, 1*b*, 1*c*, and 1*d*, for example, made of aluminum as is conventional. The jamb member 1 also comprises a stationary sealing lip 1*e*. The sash frame member 2 comprises sash sections 2*a*, 2*b*, 2*c*, 2*d*, and 2*e*. Sections 2*c* and 2*d* are preferably made of a heat insulating material. A window pane 2*f* is conventionally mounted in the sash frame by sealing strips 2*g* and 2*h*. The sash frame opens in the direction of the arrow 21. A gap 3 is formed between the jamb member 1*a* of the stationary jamb 1 and the sash member 2*b* of the movable sash frame 2 in the locked condition as shown in FIG. 1. The sash lock is located in this gap 3. A sealing lip 5 secured to the sash section or member 2*b* seals the gap 3 in the closed condition in which the closed sealing lip 5 bears elastically against a lateral surface of the jamb section 1*a*.

The stationary locking elements 6 are secured in a groove 17 of the jamb section 1*a* as will be described in more detail below. The movable locking elements 7 are secured in a groove 18 of an operating push rod 10 as will also be described in more detail below. The push rod 10 is slidably received in a guide groove 10' of the sash section or member 2*b*. The up and down movement of the push rod 10 in the guide groove 10' is accomplished by a conventional manual lever not shown. The rod 10 moves, guided in the guide groove 10' perpendicularly to the plane of FIG. 1 so as to bring the movable locking elements 7 into different elevational positions. In the shown elevational position the movable locking elements 7 engage the stationary locking elements 6 so that the sash frame 2 is locked to the jamb 1. The spacing between the locking elements 6 and 7 is somewhat exaggerated in FIG. 1 because normally the surfaces of these locking elements will contact each other. The stationary locking elements 6 and the movable locking elements 7 are longitudinally distributed along the length of the sash member and the respective frame member. The stationary locking element 6 has a projection 8 which is axially slidable into a recess 9 of the movable locking element 7. The stationary locking element 6 has a recess 11 cooperating with a projection 12 of the movable locking element 7. The recess 9 and the projection 8 have a common central axis or plane 22 which extends, according to the invention, in parallel to a frame plane 23 defined by the sash frame 2 and the jamb 1 when the sash frame 2 is in the shown closed position. The recess 11 and the projection 12 have a common central axis or plane 24 which also extends in parallel to the frame plane 23. Depending on the relative elevational position of the movable locking elements 7, there will be either engagement between the locking elements 6 and 7, or disengagement. When the locking elements are disengaged, the sash frame 2 may be opened in the direction of the arrow 21 by a hinging movement about a hinge not shown.

According to the invention the stationary locking element 6 further comprises alongside the recess 11, and laterally inwardly, an edge strip or lateral support extension 13 having a surface or bearing surface extending substantially perpendicularly to the plane 23. The stationary locking element 6 has a further lateral edge strip or support extension 14 also having a surface or bearing surface extending perpendicularly to the plane 23. The movable element 7 is similarly equipped with a lateral support extension 15 having a surface extending perpendicularly to the plane 23. The movable locking element 7 has an additional laterally outwardly located edge strip or lateral support extension 16 also with a bearing surface extending perpendicularly to the plane 23. Thus, the bearing surfaces of the support extensions 13 and 15 face each other and so do the support surfaces of the lateral extensions 14 and 16. Due to this construction of the locking elements according to the invention, even a slight movement of the sash frame 2 in the direction of the arrow 21 causes the surfaces of the lateral support extensions to bear against each other, thereby transmitting compression loads into the respective sash and jamb members and relieving the projections 8 and 12 from bending stress to counteract any force tending to open the sash frame 2. Thus, the locked condition of the sash frame 2 is maintained even against substantial breaking forces.

The stationary locking element 6 is secured in the above mentioned groove 17 by horizontally projecting edges extending into a respective cut-back or back tapered recess 17' of the groove 17. Additionally, a threaded bore receiving a set-screw 19 extends with its longitudinal axis in parallel to the frame plane 23 so that the set-screw 19 bears against the bottom of the groove 17, thus securing the locking element 6 in a force-locking manner in the groove 17. Similarly, the movable locking element 7 also has horizontally projecting edges reaching into a respective groove 18 in the operating rod 10. The groove 18 is also provided with cut-back or back tapering recesses to receive the horizontally projecting edges of the movable locking element 7. A threaded bore receiving a set-screw 20 also extends with its longitudinal axis in parallel to the frame plane 23 so that the set-screw 20 bears against the bottom of the groove 18 to hold the movable locking element 7 in a force-locking manner in the groove 18.

It will be noted that the projection 8 and the recess 9 form approximately a dove-tail type joint when the locking elements 6 and 7 are in their locked position. The dove-tail type joint has the advantage that the gap 3 can be relatively narrow while still permitting a relatively wide dimension of the locking elements or rather of the projection 8 and the recess 9 in a direction perpendicularly to the frame plane 23. Thus, this type of joint provides the most strength where it is needed, namely against a force which is directed substantially perpendicularly to the frame plane 23.

The recess 11 forms preferably a socket-type recess adapted for receiving a plug-type projection 12 as shown in FIG. 1. Thus, the "plug" forms essentially a guide bar 12 riding in a guide groove 11, whereby the axial movement of the locking elements into the locking position is facilitated. This axial movement is in a direction perpendicularly to the plane defined by the drawing sheet.

The described force-locking connection with the aid of the horizontally projecting edges received in recesses and the set-screws 19 and 20 in the respective locking element 6, 7 has the advantage that the locking elements which are preferably made of a wear resistant material such as steel, can nevertheless easily be exchanged if necessary. Moreover, this feature has the advantage that a substantial strength is provided against any twisting of the locking elements about an axis extending perpendicularly to the plane of the drawing, that is in the longitudinal direction of the push rod 10. Thus, the present sash lock is capable of withstanding substantial physical forces tending to open the lock sash. The set-screws 19 and 20 may nevertheless be relatively small because the forces tending to open a sash are not effective on these set-screws which merely hold the locking elements in place in their grooves.

Figure 2:
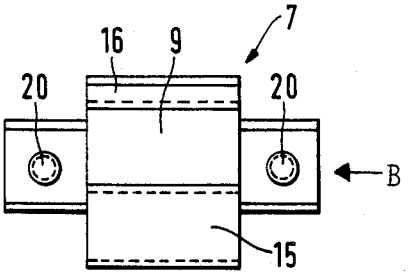
FIG. 2 is a front or plan view of one type of locking element that may, for example, be attached to an actuating push rod.
Figure 3:
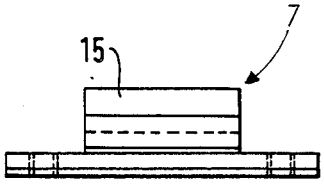
FIG. 3 is a view in the direction of the arrow A in FIG. 2.
Figure 4:
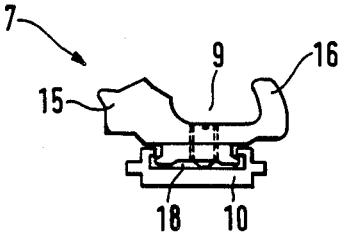
FIG. 4 is a view in the direction of the arrow B in FIG. 2.
Figure 5:
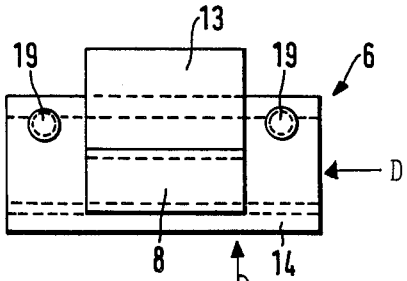
FIG. 5 shows a top plan view or front view of another type of locking element that may, for example, be secured to a jamb member.
Figure 6:
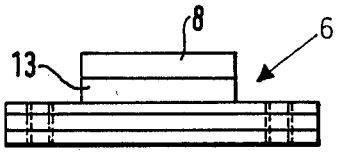
FIG. 6 is a view in the direction of the arrow C in FIG. 5.
Figure 7:
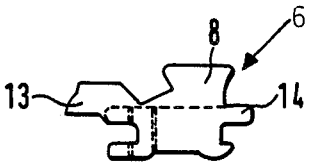
FIG. 7 is a view in the direction of the arrow D in FIG. 5.

FIGS. 2, 3, and 4 show the movable locking element 7, whereby the view of FIG. 2 is into the recess 9 revealing the lateral support extension 16 above the recess 9 and the support extension 15 below the recess 9. Set screws 20 are provided for securing the movable locking element to the operating rod 10 as described above. FIG. 3 is a view in the direction of the arrow A. FIG. 4 is a view in the direction of arrow B illustrating particularly the shape of the recess 9 in which the projection 8 of the stationary locking element 6, best seen in FIG. 7, is received. FIG. 5 is a view in the downward direction in FIG. 1 showing a view onto the stationary locking element 6 with its projection 8 between two lateral support extensions 13 and 14. FIG. 6 is a view in the direction of arrow C in FIG. 5. FIG. 7 is a view in the direction of arrow D in FIG. 5.

Although the invention has been described with reference to specific example embodiments, it will be appreciated that it is intended to cover all modifications and equivalents within the scope of the appended claims.

What I claim is:

1. A system for closing an opening in a wall, comprising stationary jamb means (1) surrounding said opening, a movable sash frame (2), said jamb means (1) and said sash frame (2) each including a respective gap member (1*a* and 2*b*) forming a gap (3) between said jamb means and said sash frame, a sash lock in said gap (3) for locking said movable sash frame to a stationary jamb defining together a frame plane (23) when said movable sash frame is closed, said sash lock comprising stationary locking means (6) and movable locking means (7) arranged for cooperation with each other in said gap between said gap member (2*b*) of said movable sash frame and said gap member (1*a*) of said stationary jamb means, operating rod means (10) movably mounted in said gap and connected to said movable locking means (7) for moving said movable locking means (7) axially and in parallel to said gap members (1*a*, 2*b*) relative to said stationary locking means (6), said movable locking means (7) and said stationary locking means (6) each comprising at least one projection (8, 12) and at least one recess (9, 11) cooperating with each other for said locking, said projections and said recesses having cross-sectional central axes (22, 24) extending in parallel to said frame plane (23), each of said stationary locking means (6) and each of said movable locking means (7) further comprising at least one lateral support extension (13, 14; 15, 16) arranged in such positions that bearing surfaces of said lateral support extensions bear against each other in the closed position of said movable sash frame, and extend substantially perpendicularly to said frame plane (23) for transferring compression loads through the respective gap member into the jamb means and into the sash frame for preventing damage to said projections (8, 12) and to said recesses (9, 11).

2. The system of claim 1, wherein at least one of said projections and at least one of said recesses have a dove-tail type cross-sectional configuration for forming a dove-tail type joint in the locked state of said sash lock.

3. The system of claim 1, wherein at least one of said projections and at least one of said recesses have a plug and socket crosssectional configuration for forming a plugged-in type joint in the locked state of said sash lock.

4. The system of claim 1, wherein said stationary locking means (6, 8) and said movable locking means (7, 9) respectively comprise horizontally projecting edges, said operating rod means (10) and said stationary gap member (1*a*) each comprising a groove, each of said horizontally projecting edges being received in its respective groove, threaded bores in said stationary locking means and in said movable locking means, and set-screws in said threaded bores for providing a force locking fit of said horizontally projecting edges in the respective groove when said set screw is tightened to bear against a groove wall.

5. The system of claim 4, wherein said stationary locking means and said movable locking means are made of a wear resistant material, such as steel.

6. The system of claim 1, wherein each of said stationary locking means and of said movable locking means comprises two of said lateral support extensions arranged so that one lateral support extension is located along one edge of the respective locking means while the other support extension is located along the other edge of the respective locking means, both lateral support extensions having surfaces bearing against respective surfaces in the closed position of said sash frame, said surfaces being arranged so that they extend substantially perpendicularly to said frame plane.

7. The system of claim 1, wherein said sash frame or said stationary jamb has a longitudinal guide groove in which said operating rod is slidably received for moving said movable locking means.

* * * * *